United States Patent [19]

Huntsberry

[11] Patent Number: 4,482,062

[45] Date of Patent: Nov. 13, 1984

[54] CARDED GOODS MERCHANDISER

[75] Inventor: David L. Huntsberry, Indian Head Park, Ill.

[73] Assignee: Microdot Inc., Darien, Conn.

[21] Appl. No.: 438,032

[22] Filed: Nov. 1, 1982

[51] Int. Cl.[3] ..... A47F 7/00

[52] U.S. Cl. ..... 211/57.1; 211/95; 211/163

[58] Field of Search ..... 211/57.1, 59.1, 163, 211/95, 195, 196

[56] References Cited

U.S. PATENT DOCUMENTS

| | | | |
|---|---|---|---|
| 1,832,801 | 11/1931 | Wright | 312/257 R X |
| 2,033,430 | 3/1936 | Kirik | 211/95 |
| 2,868,386 | 1/1959 | Seyforth | 211/95 |
| 3,502,226 | 3/1970 | Marschak | 211/163 |

FOREIGN PATENT DOCUMENTS

| | | | |
|---|---|---|---|
| 475770 | 11/1937 | United Kingdom | 211/163 |

*Primary Examiner*—Ramon S. Britts
*Assistant Examiner*—Sarah A. Lechok
*Attorney, Agent, or Firm*—Lyman R. Lyon

[57] ABSTRACT

The invention relates to a carded goods merchandiser comprising a plurality of like racks each of which has a plurality of horizontally extending vertically spaced fingers thereon and a like plurality of vertically spaced apertures horizontally aligned with said fingers. The fingers of each rack are accepted in the apertures of an adjacent normally related rack to form a rigid free standing rectangular array. The fingers on each rack have vertical web portions that are accepted in vertical slots of merchandise mounting cards.

3 Claims, 4 Drawing Figures

CARDED GOODS MERCHANDISER

BACKGROUND OF THE INVENTION

Carded goods merchandising of small metal parts, for example, hose clamps, has proved to be a successful way of identifying a manufacturer with a product in a customer's mind as well as appealing to the impulse buyer when the merchandiser is placed adjacent check-out or display counters as opposed to being placed under glass or in boxes stacked on shelves. The merchandiser may be mounted as a free standing counter display unit or as a free revolving device against a vertical display surface, including retail merchandising gondolas or other pegboard-type merchandising devices. However, since carded goods merchandisers must be provided for every retail outlet handling a manufacturer's goods, the cost of such merchandising becomes prohibitive in the absence of a relatively low cost carded goods merchandiser.

SUMMARY OF THE INVENTION

A carded goods merchandiser in accordance with the instant invention comprises four identical plastic racks made by, for example, injection molding, transfer molding, heat forming, or stamping. The racks are interlocked with one another and to a pair of bearing elements to form a relatively rigid and unique carded goods merchandiser. The racks are designed so as to be self-locking and, when assembled, free standing in conjunction with a centrally disposed support shaft. The merchandiser accepts complementary cards to which goods are secured by, for example, shrink wrapping, whereby the goods are visible on the cards. The cards are positively positioned on the merchandiser due to a novel vertical slot in the card that accepts a complementary vertically oriented, horizontally extending arm on the merchandiser.

DETAILED DESCRIPTION OF THE PREFERRED EMBODIMENT OF THE INVENTION

Figure 1:
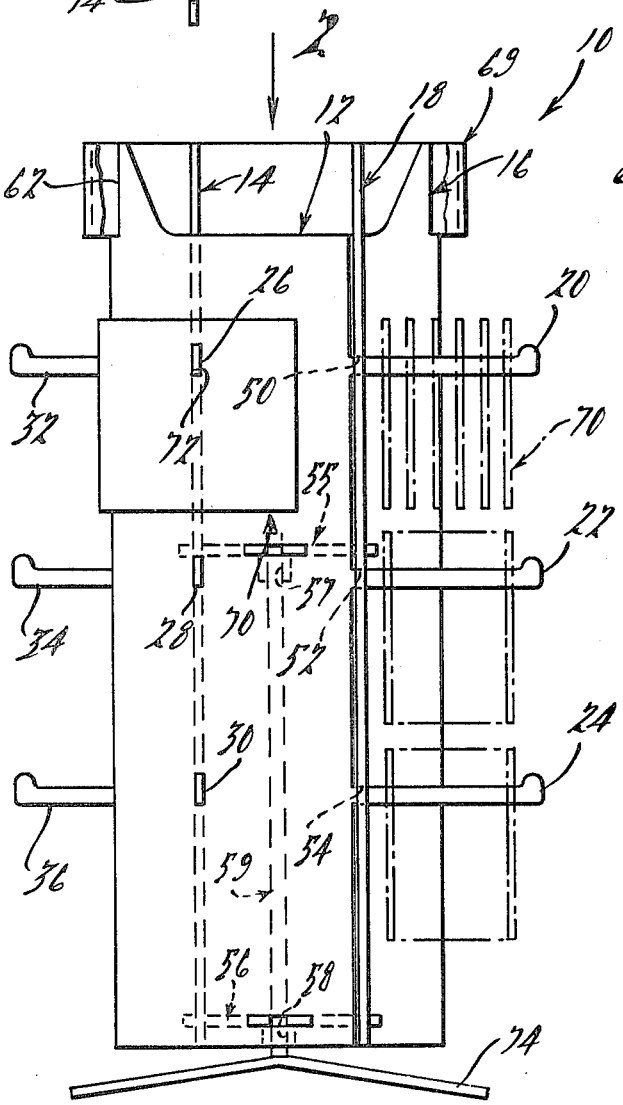
FIG. 1 is a front elevational view of a carded merchandiser in accordance with the instant invention.

A carded goods merchandiser 10 in accordance with a constructed embodiment of the instant invention comprises four identical panels or racks 12, 14, 16 and 18 which are injection molded, transfer molded, heat formed or stamped from sheet plastic, for example, rigid vinyl sheet. Each of the racks 12, 14, 16 and 18 is provided with three laterally extending fingers 20, 22, 24; 26, 28, 30; 32, 34, 36; and 38, 40 and 42; respectively. The fingers 20, 22 and 24 on the rack 12, the fingers 26, 28 and 30 on the rack 14, and the fingers 32, 34 and 36 on the rack 16 are illustrated in FIG. 1 of the drawing. The fingers 38, 40 and 42 are illustrated in FIG. 3 of the drawing.

Figure 2:
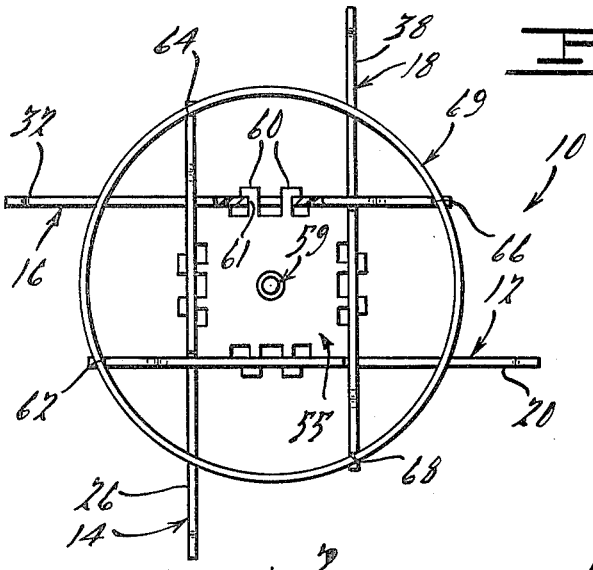
FIG. 2 is a view taken in the direction of the arrow 2 of FIG. 1.
Figure 4:
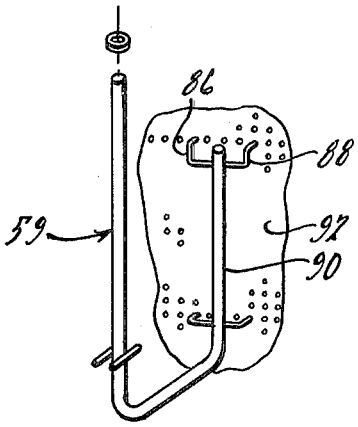
FIG. 4 is a perspective view of a pegboard wall mount for the carded goods merchandiser.
Figure 3:
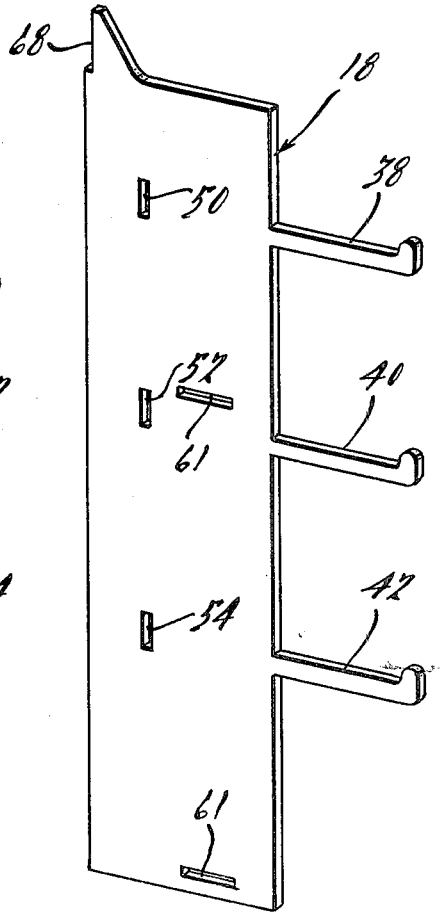
FIG. 3 is a perspective view of one of the merchandiser panels.

As best seen in FIGS. 1 and 3 of the drawing, the rack 18 is provided with apertures 50, 52 and 54 for the acceptance of the fingers 20, 22 and 24 on the rack 12 which is orientated at a right angle thereto. It is to be understood that each of the racks 12, 14, 16 and 18 is provided with apertures similar to the apertures 50, 52 and 54, complementary to the fingers in the rack that is orientated at a right angle and in a counterclockwise direction relative thereto, as seen in FIG. 2.

As best seen in FIGS. 1 and 2 of the drawings, the racks 12, 14, 16 and 18 are retained in a rectangular interlocked array by a pair of square bearing plates 55 and 56 that have central apertures 57 and 58, respectively, for journaling a support shaft 59. The bearing plates 55 and 56 have spring fingers 60 on each side thereof that are accepted in complementary slots 61 in the racks 12–16.

As best seen in FIG. 2, shoulders 62, 64, 66 and 68 of the racks 12, 14, 16 and 18, respectively. It is to be understood that when assembled, the racks 12, 14, 16 and 18 are precluded from movement relative to one another and are maintained in the generally rectangular array seen in FIG. 2.

As seen in FIG. 1 of the drawings, a card 70 having a vertically orientated aperture 72 therein is mounted on the finger 26. The card 70 is sized so as to be acceptable between the vertically spaced fingers 26 and 28, the lateral dimension of the card 70 being dictated by the adjacent rack 18 which extends parallel to the finger 26. It is to be noted that the vertical slot 72 in the card 70 interlocks with the vertically disposed web portion of the finger 26 to preclude swinging of the card 70. Also, the vertical orientation of the web portion of the fingers stiffens the fingers against loads carried thereby.

As seen in FIG. 1, the merchandiser 10 is supported for rotation by the central shaft 59 which is journaled in the bearing plates 55 and 56. The shaft 59 may be provided with suitable legs 74. Alternatively, the shaft 59 may be of U-shaped configuration having suitable hooks 86 and 88 on a leg portion 90 thereof for acceptance in, for example, a conventional vertically orientated pegboard 92.

While the preferred embodiment of the invention has been disclosed, it should be appreciated that the invention is susceptible of modification without departing from the scope of the following claims.

I claim:

1. A carded goods merchandiser comprising:

four substantially identical racks, each of said racks having a plurality of horizontally extending vertically spaced and aligned integral fingers thereon and a like plurality of vertically spaced apertures, said apertures being horizontally aligned with the fingers thereof and vertically aligned with one another, the fingers of each rack being accepted in the apertures of an adjacent normally related rack to retain said adjacent rack in a rigid free standing array and to provide display support for a plurality of merchandise cards.

2. The merchandiser of claim 1 wherein said fingers have a vertical web portion.

3. The merchandiser of claim 2 including a plurality of cards having vertical slots therein for the acceptance of the fingers on said racks.

* * * * *